US007605765B2

(12) United States Patent
Ku

(10) Patent No.: US 7,605,765 B2
(45) Date of Patent: Oct. 20, 2009

(54) BUILT-IN ANTENNA MODULE FOR PORTABLE WIRELESS TERMINAL

(75) Inventor: Do-Il Ku, Suwon-si (KR)

(73) Assignee: Samsung Electronics Co., Ltd (KR)

( * ) Notice: Subject to any disclaimer, the term of this patent is extended or adjusted under 35 U.S.C. 154(b) by 35 days.

(21) Appl. No.: 11/925,550

(22) Filed: Oct. 26, 2007

(65) Prior Publication Data

US 2008/0100519 A1 May 1, 2008

(30) Foreign Application Priority Data

Oct. 27, 2006 (KR) ..... 10-2006-0105324

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/793, 343/797, 810–820, 846, 700 MS, 702, 848
See application file for complete search history.

(56) References Cited

U.S. PATENT DOCUMENTS 6,922,172 B2 * 7/2005 Oshiyama et al. ..... 343/700 MS
7,292,193 B2 * 11/2007 Jang ..... 343/702
7,397,434 B2 * 7/2008 Mun et al. ..... 343/702
2003/0206136 A1 * 11/2003 Chen ..... 343/702
2006/0066490 A1 * 3/2006 Ku et al. ..... 343/702

FOREIGN PATENT DOCUMENTS

| | | |
|---|---|---|
| JP | 2002-344231 | 11/2002 |
| KR | 1020060025884 | 3/2006 |
| KR | 1020060057695 | 5/2006 |
| KR | 1020060068741 | 6/2006 |
| KR | 1020060104872 | 10/2006 |
| WO | WO 01/37369 | 5/2001 |

* cited by examiner

*Primary Examiner*—Shih-Chao Chen
(74) *Attorney, Agent, or Firm*—The Farrell Law Firm, LLP

(57) ABSTRACT

A built-in antenna module includes a main board including a feed pad, a ground pad, and a ground layer having a predetermined area; an antenna radiator installed on the main board to have a predetermined height, and including a feed pin and a ground pin, the feed pin and the ground pin being electrically connected to the feed pad and the ground pad of the main board, respectively; a conductor disposed on an inner surface of a case frame and having a predetermined area and thickness, the case frame providing an installation space for the main board and forming an exterior of the terminal; and at least one electrical connection unit interposed between the conductor and the main board and serving as a medium that electrically connects the conductor to the ground pad and the ground layer of the main board.

14 Claims, 6 Drawing Sheets

BUILT-IN ANTENNA MODULE FOR PORTABLE WIRELESS TERMINAL

PRIORITY

This application claims priority under 35 U.S.C. §119 to an application filed in the Korean Intellectual Property Office on Oct. 27, 2006 and assigned Serial No. 2006-105324, the contents of which are incorporated herein by reference.

BACKGROUND OF THE INVENTION

1. Field of the Invention

The present invention relates generally to a built-in antenna module embedded in a portable wireless terminal, and in particular, to a built-in antenna module for a portable wireless terminal configured to improve a radiation characteristic of a Planar Inverted-F Antenna (PIFA), and antenna performance such as reducing the Specific Absorption Rate (SAR).

2. Description of the Related Art

Recently, terminals with various functions and designs are being introduced. Consumers' demands for smaller, lighter and slimmer terminals with various functions are increasing. To meet such consumers' demands, terminal providers are focusing on reducing the volume of a terminal while maintaining or improving functions thereof.

In regard to an antenna, a rod antenna (or a whip antenna) and a helical antenna that protrude outwardly of a terminal are susceptible to drop damage, and reduce portability of the terminal. Therefore, a plate type built-in antenna (i.e., a so called 'internal antenna' or 'intenna') installed inside a terminal is widely used, and various efforts have been made to improve a characteristic of the built-in antenna and also improve productivity and assembly thereof.

In general, the built-in antenna module includes a predetermined plate-type antenna radiator that is electrically connected onto a main board (i.e., Radio Frequency board) of a terminal. The built-in antenna radiator has two feed lines. One of the feed lines is electrically connected to an antenna feed unit of the main board, and the other one is operated, grounded to a ground layer formed as a conductor of the main board having a multi-layered structure. Here, the ground layer is formed or installed at the farthest location of the main board from the antenna radiator. The antenna radiator has a predetermined distance from the ground layer. The antenna radiator is grounded with only a ground point and a feed point extending downward, separated from the main body at the predetermined distance by a predetermined antenna carrier. Here, the antenna carrier is formed to facilitate fixation to the main board.

The plate type built-in antenna radiator having such feed and ground structures is called a Planar Inverted F-Antenna (PIFA) radiator. The PIFA has been known to improve antenna performance as the size of a radiator, an area of a ground surface, and a distance between the radiator and the ground surface increase.

To meet such conditions for improving the PIFA characteristics while minimizing the volume of a terminal, a separate ground plate with a predetermined distance is used on a surface of a main board opposite to a surface where the antenna radiator is installed, so that the distance between the antenna radiator and the ground surface can be increased as much as possible and thus the radiation characteristic can be improved.

However, the structure requires a complicated assembly process and a high terminal manufacturing cost because of the installation of the separate ground plate, and has limitations in expanding the distance between the antenna radiator and the ground surface using the ground plate.

SUMMARY OF THE INVENTION

An aspect of the present invention is to substantially solve at least the above problems and/or disadvantages and to provide at least the advantages below. Accordingly, an aspect of the present invention is to provide a built-in antenna module for a portable wireless terminal configured to improve antenna performance without increasing the volume of the terminal, by maximizing a distance between a radiator and a ground surface using a case frame of the terminal.

Another aspect of the present invention is to provide a built-in antenna module of a portable wireless terminal configured to improve a radiation characteristic of the built-in antenna module by providing a maximum distance between an antenna radiator and a ground surface without using a separate ground plate.

Still another aspect of the present invention is to provide a built-in antenna module for a portable wireless terminal configured to improve a radiation characteristic of the antenna module and reduce the Specific Absorption Rate (SAR) by grounding an antenna radiator with an inner surface of a case frame together with a ground surface of the main board.

Further another aspect of the present invention is to provide a built-in antenna module for a portable wireless terminal configured to implement a high-quality terminal by achieving a slim profile of the terminal and also improving radiation performance of the antenna module.

According to one aspect of the present invention, a built-in antenna module for a portable wireless terminal includes a main board having a feed pad, a ground pad, and a ground layer having a predetermined area; an antenna radiator installed on and at a predetermined distance from the main board, and including a predetermined feed pin and a predetermined ground pin, the feed pin and the ground pin being electrically connected to a feed pad and a ground pad of the main board, respectively; a conductor installed or formed on an inner surface of a case frame and having a predetermined area and thickness, the case frame providing an installation space for the main board and forming an exterior of the terminal; and at least one electrical connection unit interposed between the conductor and the main board and serving as a medium that electrically connects the conductor to the ground pad and the ground layer of the main board.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Preferred embodiments of the present invention will be described herein below with reference to the accompanying drawings. In the following description, well-known functions or constructions are not described in detail since they would obscure the invention in unnecessary detail.

A slide type terminal is illustrated in describing the present invention, but the present invention is not limited thereto. For example, the present invention may be applied to various wireless devices such as Personal Digital Assistants (PDAs), general terminals, and wireless notebook computers including plate type built-in antenna modules.

Figure 1:
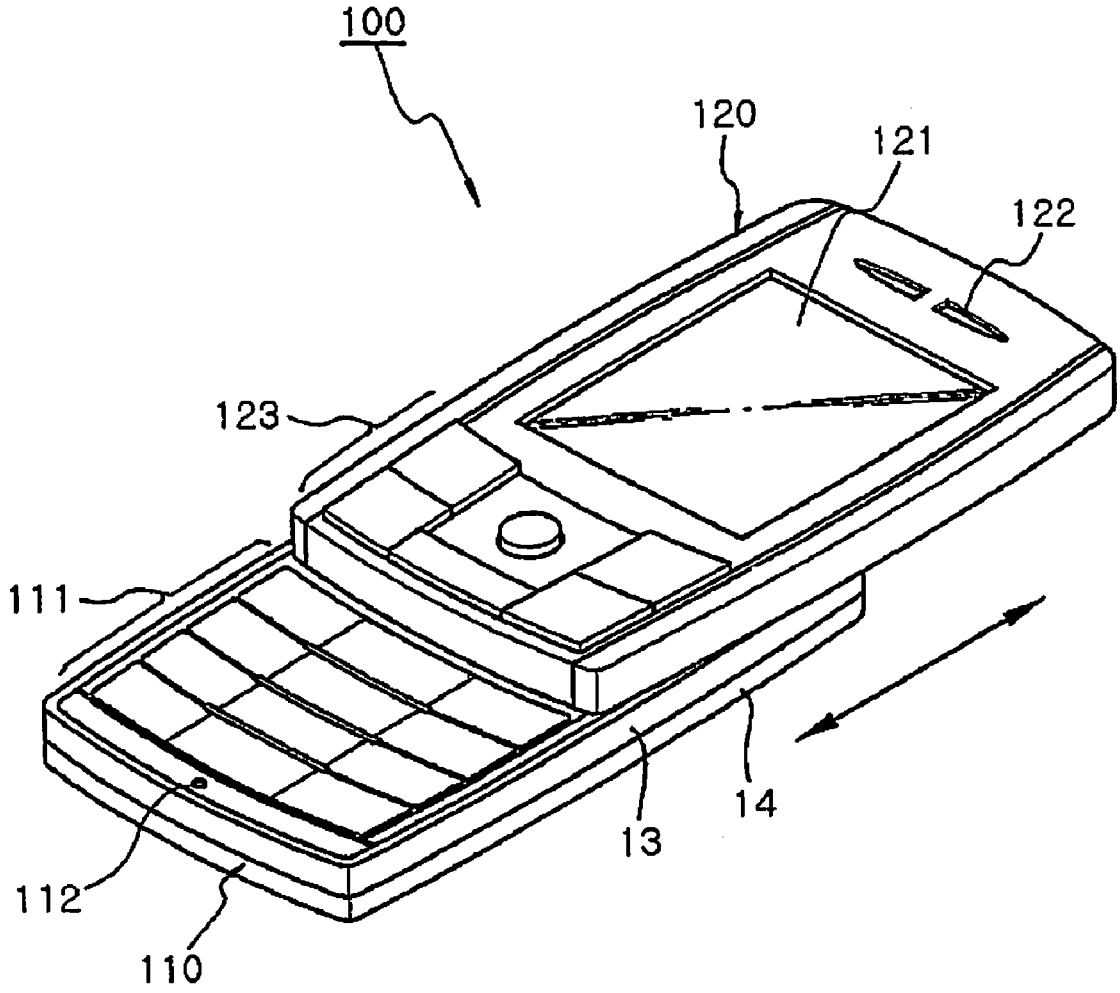
FIG. 1 is a front perspective view of a slide type portable wireless terminal including a built-in antenna module according to an embodiment of the present invention.
Figure 2:
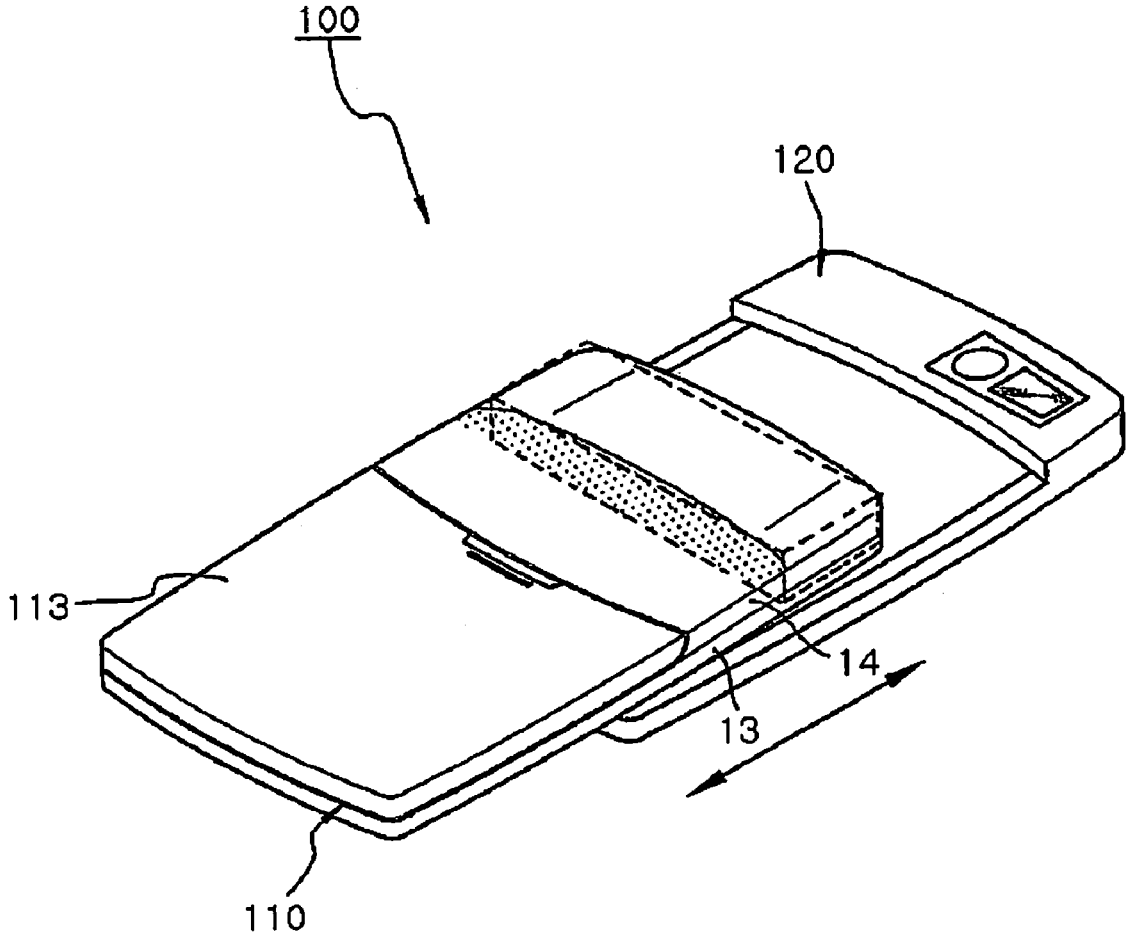
FIG. 2 is a rear perspective view of a slide type portable wireless terminal, showing an installation location of a built-in antenna module according to an embodiment of the present invention.

As illustrated in FIGS. 1 and 2, the slide type portable wireless terminal 100 includes a main body 110, and a slide body 120 that can slide a predetermined length on the main body 100 in a length direction of the terminal 100. The slide body 120 is installed on the main body 110. As illustrated in FIG. 2, the slide body 120 is slid over the main body 110 to the predetermined length, and is used for overall functions of the terminal such as a call operation.

A display unit 121 is installed on a front surface of the slide body 120. The display unit 121 may be a color wide Liquid Crystal Display (LCD) module, and may be a touch screen panel. A speaker unit 122 is installed above the display unit 121, and at least one keypad assembly 123 is installed under the display unit 121. The keypad assembly 123 may include a functional key button or a navigating key button so that a user can use a portion of functions of the terminal without opening the slide body 120 on the main body 110.

Another keypad assembly 111 including a plurality of key buttons may be installed on a surface of the main body 110 viewed when the slide body 120 is opened on the main body 110. The keypad assembly may be number key buttons (3×4 key buttons). A microphone unit 112 is installed under the keypad assembly 111.

The main body 110 includes upper and lower case frames 13 and 14, respectively, and a built-in antenna module (10 of FIG. 3) is provided within a predetermined space defined by the upper and lower case frames 13 and 14. As the built-in antennal module, a Planar Inverted F-Antenna (PIFA) may be used. The built-in antenna module 10 may be installed in an inner side (indicated by a dotted line in FIG. 2) of a rear upper portion of the main body 110 above a battery pack 113.

Figure 3:
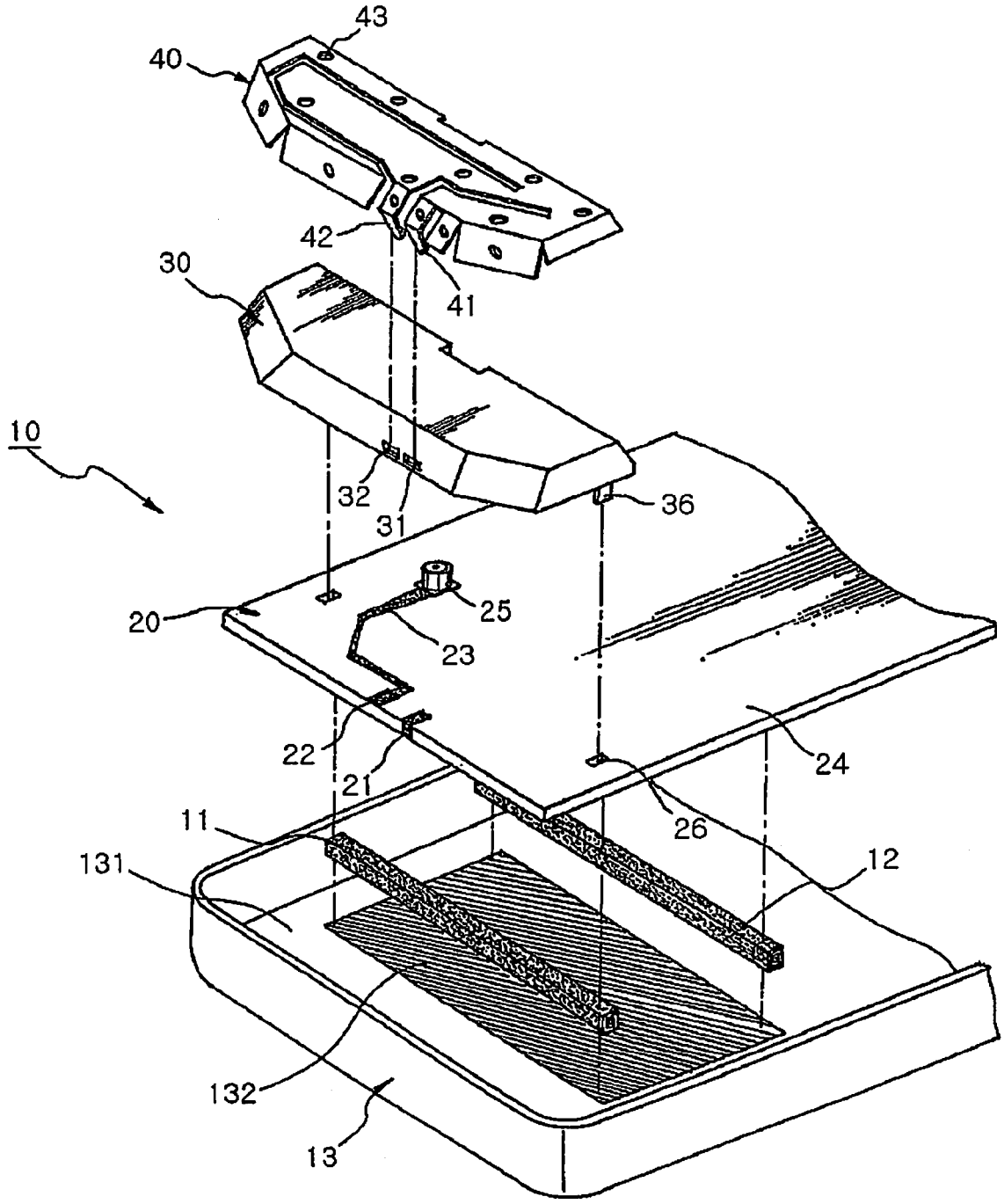
FIG. 3 is an exploded perspective view of a built-in antenna module according to the present invention.

FIG. 3 is an exploded perspective view of a built-in antenna module 10 according to the present invention. The built-in antenna module 10 includes the upper case frame 13 of the terminal, a main board 20 installed in the case frame 13, an antenna radiator 40 installed on the main board 20, and an Electro-Magnetic Interference (EMI) pigment 132 applied on an inner surface 131 of the case frame 13 to face a bottom surface 24' (see FIG. 4) opposite a top surface 24 of the main board 20 on which the antenna radiator 40 is installed.

The main board 20 includes a ground pad 21 and a feed pad 22 on the top surface 24. The ground pad 21 and the feed pad 22 are electrically connected respectively to a ground pin 41 and a feed pin 42 extending from the antenna radiator 40. The feed pad 22 is electrically connected to a Radio Frequency (RF) connector 25 by a pattern 23 formed on the main board 20.

The antenna radiator 40 may be fixed on an antenna carrier 30 having a predetermined height. The antenna carrier 30 may be formed of a synthetic resin. This is because if the antennal radiator 40, a thin metallic plate, is fixed directly onto the main board 20 without the antenna carrier 30, the shape of the antenna radiator 40 might be twisted afterward, deteriorating a radiation characteristic of the antenna module. Thus, the antenna radiator 40 may include a plurality of opening 43 and thus be fixed to the antenna carrier 30 by, for example, ultrasonic welding. The antenna carrier 30 may include through holes 31 and 32 at predetermined locations, so that the ground pin 41 and the feed pin 42 of the antenna radiator 40 pass through the through holes 31 and 32 and are connected to the ground pad 21 and the feed pad 22 of the main board 20, respectively. Also, fixing protrusions 36 protrude downwardly from both sides of the antenna carrier 30. The fixing protrusions 36 are inserted in fixing grooves 26 formed in the main board 20 so that the antenna carrier 30 can be firmly fixed to the main board 20.

The EMI pigment 132 is formed on the inner surface 131 of the case frame 13 of the terminal. The EMI pigment 132 may be deposited or applied on the inner surface 131 of the case frame 13. The EMI pigment 132 may have a greater area than that of the antenna radiator 40, and may be applied or deposited at a location overlapping a portion of the main board 20 where the antenna radiator 40 is installed. Thus, one end of the EMI pigment 132 is electrically connected to the ground pad 21, and the other end thereof is electrically connected to a ground layer (29 of FIG. 4) of the main board 20, so that the EMI pigment 132 may serve as a ground surface for the antenna radiator 40.

However, the present invention is not limited to the above description. Besides the EMI pigment 132, similar conductors may be used. Examples of the conductor may include a metal plate or a Flexible Printed Circuit (FPC) that has a predetermined area and thickness, and the conductor is attached to the inner surface 131 of the case frame 13. For example, the metal plate excluding a portion for the electrical connection may be inserted into the case frame 13 by insertion molding when the case frame 13 is fabricated.

Of course, an electrical connection unit is used for an electrical connection of the ground pad 21 and the ground layer (item 29 in FIG. 4) with the EMI pigment 132 as the conductor. As the electrical connection unit, conductive tapes 11 and 12, each formed by being wound a plurality of times and having a predetermined height, are used. However, the electrical connection unit is not limited to the conductive tapes, but other materials such as a conductive foam or a plate type metal spring may also be used.

Figure 4:
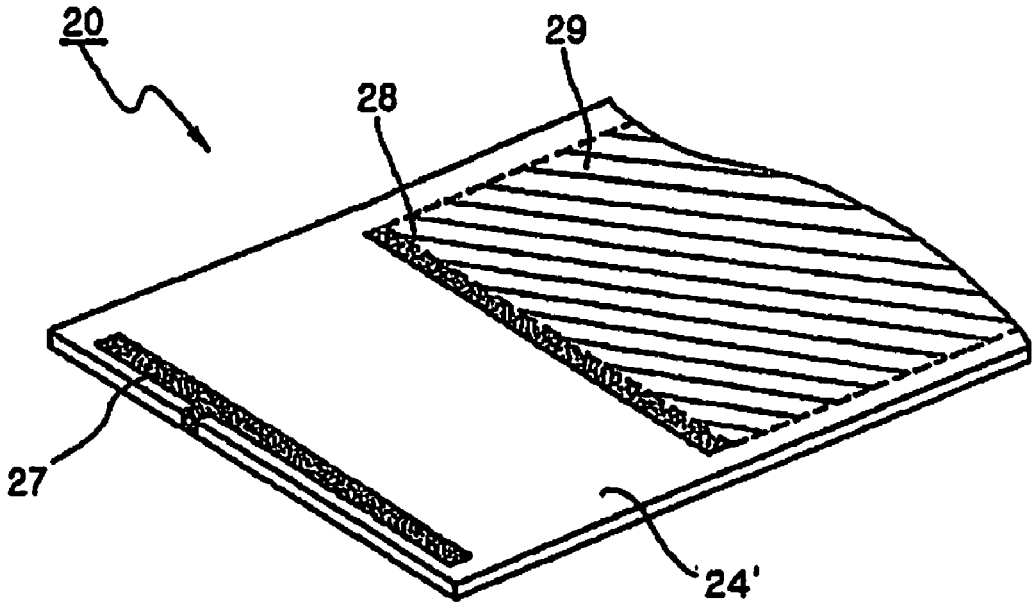
FIG. 4 is a rear perspective view of a main board according to the present invention.

FIG. 4 is a rear perspective view of the main board 20 according to the present invention. The ground layer 29 is formed on the bottom surface 24' of the main board 20 opposite the top surface 24 where the antenna radiator 40 is installed. The ground layer 29 serves to ground various electronic function groups used in the portable wireless terminal 100, and also serves as a ground surface of the antenna radiator 40. Thus, the ground layer 29 may be formed on a bottom surface of the main board 20, which is located at the farthest vertical distance from the antenna radiator 40. The ground layer 29 may not be formed in a clearance area on the bottom surface 24'; the clearance area is an area in which the antenna radiator 40 is orthogonally projected on the bottom surface 24'.

Of course, a first contact point 27 electrically connected to the ground pad 21 is formed on the bottom surface 24' opposite the top surface 24 where the ground pad 21 is formed, therefore the first contact point 27 may be electrically connected to the ground pad 21 through a via. Also, a second contact point 28 electrically connected to the ground layer 29 is exposed on the bottom surface 24', and the ground layer 29 is not exposed from the main board 20 in general. Particularly, the first and second contact points 27 and 28 may be used as contact points with the conductive tapes 11 and 12, the electrical connection unit (FIG. 5).

Figure 5:
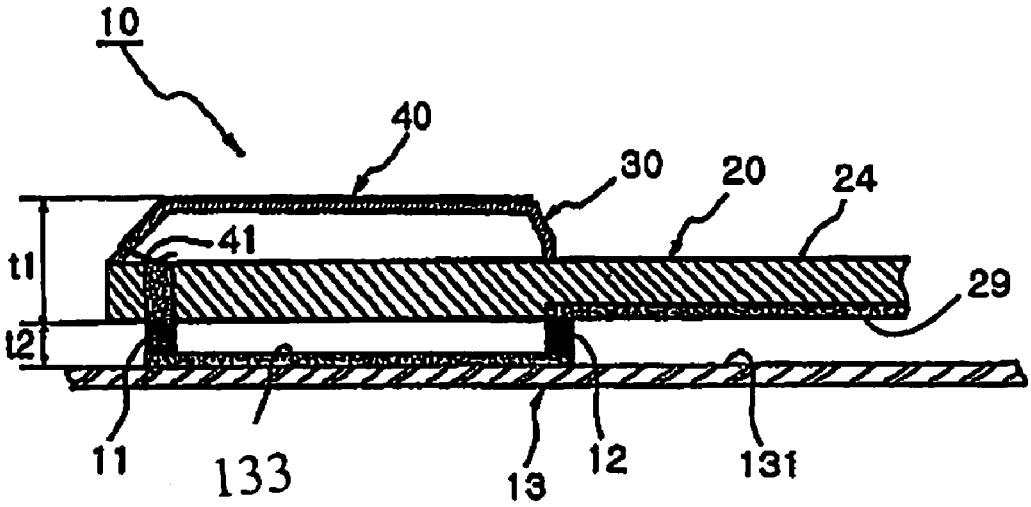
FIG. 5 is a cross-sectional view of a main part, illustrating that a built-in antenna module is installed on a main board according to the present invention.

FIG. 5 is a cross-sectional view of a main part, illustrating that the built-in antenna module is installed at the main board according to the present invention, which will now be described with reference to FIGS. 3 through 5, with an FPC 133 being used as the EMI pigment 132.

First, the antenna radiator 40 is fixed on the top surface 24 of the main board 20 via the antenna carrier 30. Here, the feed pin 42 of the antenna radiator 40 is connected to the feed pad 22 of the main board 20, and the ground pin 41 is connected to the ground pad 21 of the main board 20. In this case, the ground pad 21 of the main board 20 and the ground pin 41 of the antenna radiator 40 are electrically connected together, but are not yet connected to the ground layer 29 of the main board 20.

Thereafter, when the main board 20 having the antenna radiator 40 is mounted to the case frame 13, the main board 20 and the EMI pigment 132 are electrically connected together by the conductive tapes 11 and 12. Here, the first contact point 27 of the main board 20 contacts one end of the EMI pigment 132 by the conductive tape 11, and the second contact point 28 contacts the other end of the EMI pigment 132 by another conductive tape 12. Consequently, the antenna radiator 40 is grounded in the order of ground pin 41 of antenna radiator 40→ground pad 21 of main board 20→first contact portion 27 of main board 20→conductive tape 11→EMI pigment (conductor) 132→conductive tape 12→ground layer 29 of main board 20.

Thus, the EMI pigment 132 is used as a ground surface together with the ground layer 29 for the antenna radiator 40 of the main board 20. Also, since the EMI pigment 132 is formed on the inner surface 131 of the case frame 13, an effect of maximizing a distance from the antenna radiator 40 can be obtained. That is, as illustrated in FIG. 5, the distance between the antenna radiator 40 and the ground surface is t1+t2. The maximum distance between the antenna radiator 40 and the ground surface may contribute to improving radiation performance of the antenna radiator 40.

Figure 6A:
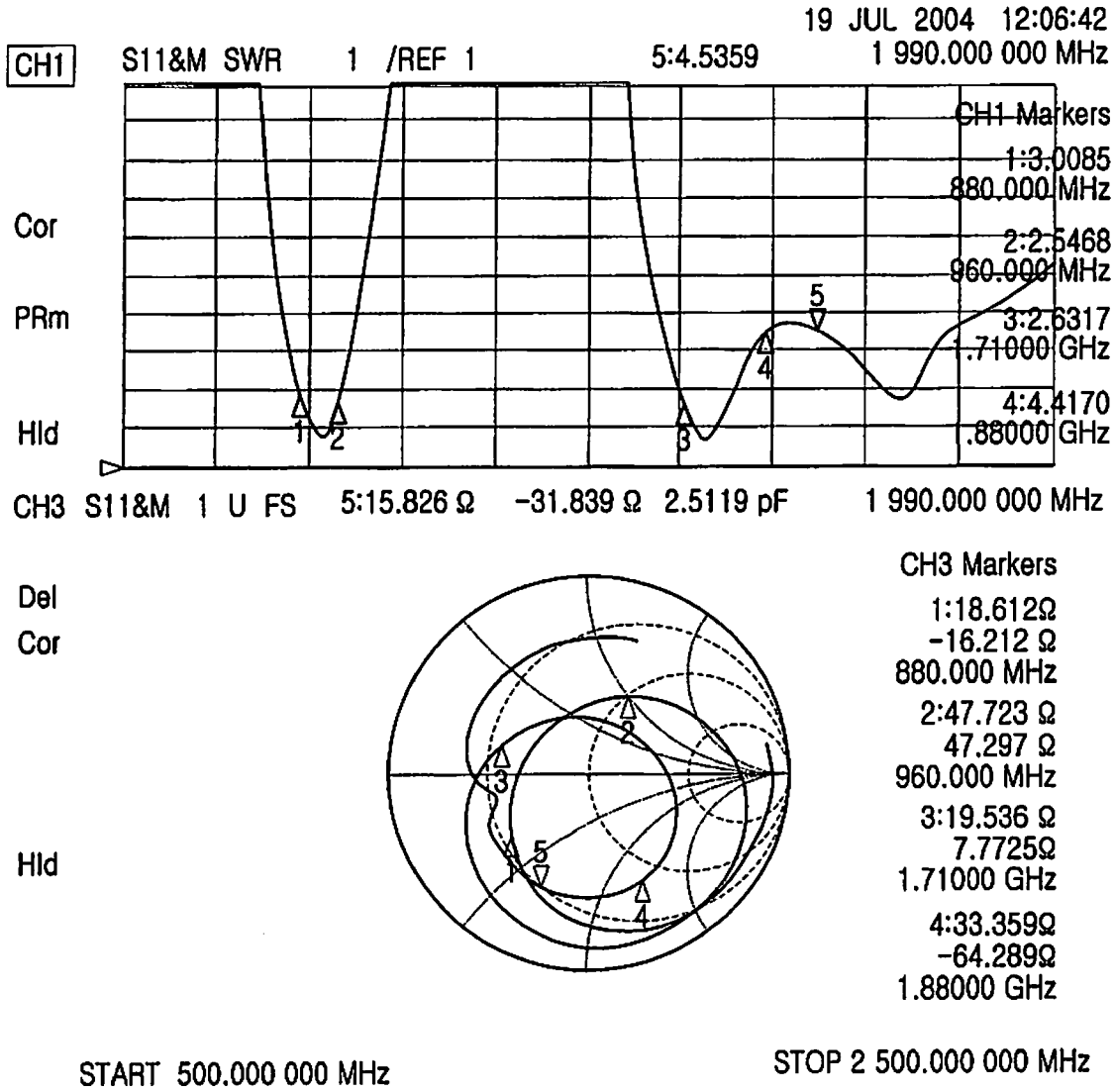
FIGS. 6A and 6B are graphs showing Voltage Standing Wave Ratio (VSWR) according to opening and closing of a slide type terminal including a built-in antenna module according to the present invention.
Figure 6B:
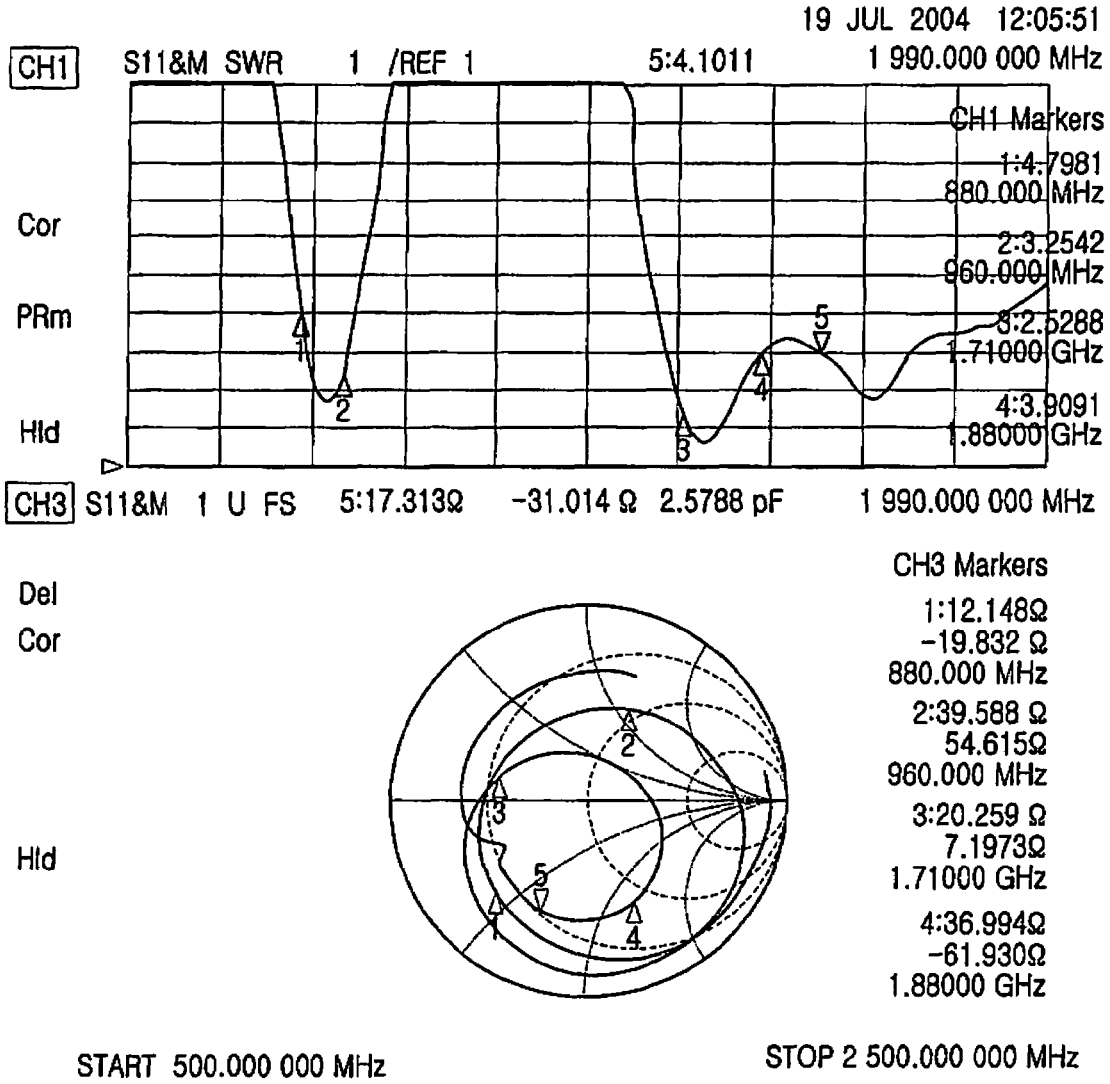

FIGS. 6A and 6B are graphs showing Voltage Standing Wave Ratio (VSWR) according to opening and closing of a slide type terminal including a built-in antenna module according to the present invention. The antenna was designed to optimize its characteristic in a Slide-up mode, an actual call mode of the terminal. Since a Slide-down mode is a reception stand-by mode in most cases, somewhat high VSWR (marker 1 and marker 3 in the drawing) in transmission does not have significant influence on the terminal performance. In actuality, it is almost impossible to implement a design that satisfies performance in both the Slide-up and Slide-down modes. Based on a mutual trade-off relation, the transmission characteristic in the Slide-down mode which less affects the terminal performance is sacrificed.

The SAR in the case of the Global System for Mobile communications (GSM) and the SAR in the case of the Digital Cellular System (DCS) are shown in Tables 1 and 2 below.

TABLE 1

| Mode | Power | Head | Position | Slide type | CH. | 10 g SAR (W/kg) |
|---|---|---|---|---|---|---|
| EGSM900 | 33 dBm | Left | Cheek | Up | 975 | 0.240 |
| | | | Cheek | Down | 975 | 0.134 |
| | | | Cheek | Up | 37 | 0.399 |
| | | | Cheek | Down | 37 | 0.315 |
| | | | Cheek | Up | 124 | 0.451 |
| | | | Cheek | Down | 124 | 0.373 |
| | | | Tilt | Up | 37 | 0.169 |
| | | | Tilt | Down | 37 | 0.165 |
| | | Right | Cheek | Up | 975 | 0.243 |
| | | | Cheek | Down | 975 | 0.138 |
| | | | Cheek | Up | 37 | 0.388 |
| | | | Cheek | Down | 37 | 0.261 |
| | | | Cheek | Up | 124 | 0.472 |
| | | | Cheek | Down | 124 | 0.401 |
| | | | Tilt | Up | 37 | 0.179 |
| | | | Tilt | Down | 37 | 0.175 |

TABLE 2

| Mode | Power | Head | Position | Slide type | CH. | 10 g SAR (W/kg) |
|---|---|---|---|---|---|---|
| EGSM900 | 33 dBm | Left | Cheek | Up | 512 | 0.109 |
| | | | Cheek | Down | 512 | 0.118 |
| | | | Cheek | Up | 700 | 0.105 |
| | | | Cheek | Down | 700 | 0.128 |
| | | | Cheek | Up | 885 | 0.098 |
| | | | Cheek | Down | 885 | 0.137 |
| | | | Tilt | Up | 700 | 0.071 |
| | | | Tilt | Down | 700 | 0.073 |
| | | Right | Cheek | Up | 512 | 0.108 |
| | | | Cheek | Down | 512 | 0.119 |
| | | | Cheek | Up | 700 | 0.088 |
| | | | Cheek | Down | 700 | 0.111 |
| | | | Cheek | Up | 885 | 0.109 |
| | | | Cheek | Down | 885 | 0.125 |
| | | | Tilt | Up | 700 | 0.071 |
| | | | Tilt | Down | 700 | 0.055 |

As shown in Table 1 and Table 2, the SAR was maximum 0.472 W/kg in the case of the GSM, and was maximum 0.137 W/kg in the case of the DCS. It can be seen that excellent performance can be achieved compared to the average 2.0 W/kg per 10 g of the European standard. Because the SAR characteristic has recently been emphasized to a great extent and strictly managed internationally, such results are very much satisfactory, and may be used as a reference in developing a like terminal.

In the built-in antenna module according to the present invention, a ground surface interacting with the antenna radiator is applied to the case frame of the terminal. Thus, a distance between the antenna radiator and the ground surface is maximized without increasing the volume of the terminal, so that radiation performance can be improved, and thus the slimness and high quality of the terminal can be achieved.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A built-in antenna module for a portable wireless terminal, comprising:

a main board including a feed pad, a ground pad, and a ground layer having a predetermined area;

an antenna radiator installed on a top surface of the main board and apart a predetermined distance from the main board, the antenna radiator including a feed pin and a ground pin, the feed pin and the ground pin being electrically connected to the feed pad and the ground pad of the main board, respectively;

a conductor disposed on an inner surface of a case frame of the portable wireless terminal, the conductor having a conductor area and a predetermined thickness, the case frame providing an installation space for the main board and forming an exterior of the portable wireless terminal; and at least one electrical connection unit interposed between the conductor and the main board and serving as a medium that electrically connects the conductor to the ground pad and the ground layer.

2. The built-in antenna module of claim 1, wherein the inner surface faces a bottom surface of the main board, the bottom surface opposite the top surface.

3. The built-in antenna module of claim 2, wherein the conductor is electrically connected to the antenna radiator by the at least one electrical connection unit and serves as a ground surface together with the ground layer.

4. The built-in antenna module of claim 3, wherein the conductor area overlaps a clearance area in which the antenna radiator is orthogonally projected on the bottom surface.

5. The built-in antenna module of claim 4, wherein the conductor has a thickness greater than that of the antenna radiator.

6. The built-in antenna module of claim 4, wherein the ground layer of the main body is formed without overlapping the conductor area.

7. The built-in antenna module of claim 6, wherein one end of the conductor is electrically connected to the ground pad by one electrical connection unit, and an other end of the conductor is electrically connected to the ground layer by an other electrical connection unit.

8. The built-in antenna module of claim 7, wherein the main board further comprises a first contact point and a second contact point, both the first and second contact points on the bottom surface, the first contact point electrically connected to the ground pad, the second contact point electrically connected to the ground layer, and the first contact point and the second contact point respectively connected to the one end and the other end of the conductor by the electrical connection units.

9. The built-in antenna module of claim 8, wherein the first contact point is electrically connected to the ground pad through a via.

10. The built-in antenna module of claim 1, wherein the conductor is one of a metal plate having a predetermined area and applied to the inner surface, a flexible printed circuit attached to the inner surface, and an electro-magnetic interference pigment applied to the inner surface.

11. The built-in antenna module of claim 10, wherein the metal plate is attached to the inner surface by bonding.

12. The built-in antenna module of claim 10, wherein the metal plate is insert-molded in such a way that only a portion of the metal plate for contacting the electrical connection unit is exposed.

13. The built-in antenna module of claim 10, wherein the at least one electrical connection unit is one of a conductive tape, a conductive foam, a plate type metal spring contacting both ends of the conductor respectively to a first contact point and a second contact point, the first and second contact points being on the main board.

14. The built-in antenna module of claim 13, wherein the antenna radiator is a planar inverted F-antenna radiator.

* * * * *